United States Patent [19]

Bunch, Jr.

[11] Patent Number: 4,917,657

[45] Date of Patent: Apr. 17, 1990

[54] CONTINUOUS FORM STATIONERY FOLDING MACHINE WITH SYSTEM FOR SIMULTANEOUSLY LOCATING STATIONERY AND LATERALLY ADJUSTING FOLDING MECHANISMS

[76] Inventor: Earnest B. Bunch, Jr., 9619 N. 21st Dr., Phoenix, Ariz. 85021

[21] Appl. No.: 304,775

[22] Filed: Jan. 30, 1989

[51] Int. Cl.[4] ..... B65H 45/20

[52] U.S. Cl. ..... 493/8; 493/411; 493/422; 493/34; 493/414

[58] Field of Search ..... 493/411–415, 493/34, 478, 479, 422, 8

[56] References Cited

U.S. PATENT DOCUMENTS 4,243,215 1/1981 Van Den Bergh ..... 493/422
4,277,058 7/1981 Biggar ..... 493/422
4,623,136 11/1986 Bunch, Jr. ..... 493/415

*Primary Examiner*—Frederick R. Schmidt
*Assistant Examiner*—Jack W. Lavinder
*Attorney, Agent, or Firm*—Tod R. Nissle

[57] ABSTRACT

An improved stationery folding machine of the type having a dispensing roller which directs a continuous strip of paper into a mechanism which distributes successive lines of weakening formed in the paper in substantially opposite directions and having additional mechanisms for creasing the distributed paper along the transverse lines of weakening to produce continuous form stationery. The machine includes apparatus which locates the position of the strip of paper in the machine and simultaneously laterally positions a plurality of folding mechanisms along at least one edge of the strip of paper.

7 Claims, 6 Drawing Sheets

CONTINUOUS FORM STATIONERY FOLDING MACHINE WITH SYSTEM FOR SIMULTANEOUSLY LOCATING STATIONERY AND LATERALLY ADJUSTING FOLDING MECHANISMS

This invention relates to apparatus for producing continuous form stationery by folding a strip of paper along transverse lines of weakening formed therealong.

More particularly, the invention concerns an improved stationery folding machine of the type having a dispensing roller which directs a continuous strip of paper into a mechanism which distributes successive lines of weakening formed in the paper in substantially opposite directions and having additional mechanisms for creasing the distributed paper along the transverse lines of weakening to produce continuous form stationery.

In another respect, the invention concerns an improved paper folding machine of the type described which locates the position of the strip of paper in the machine and simultaneously laterally positions a plurality of folding mechanisms along at least one edge of the strip of paper.

Spiral paper folding machines are well known in the art. See, for Example, U.S. Pat. No. 4,522,619 to Bunch, issued June 11, 1985, and U.S. Pat. No. 3,912,252 to Stephens, issued Oct. 14, 1975, both of which are incorporated herein by reference. Spiral paper folding machines fold in zig-zag fashion a strip of paper along transverse lines of weakening formed therealong to produce continuous form stationery. One drawback of such folding machines is the set up required to prepare the machine to fold a strip of paper having a particular width and having lines of weakening formed at selected equal intervals therealong and extending laterally across the strip of paper. During the set up of a spiral paper folding machine, the strip of paper passing through the machine and the spirals in the machine have to be orientated with respect to one another such that the spirals properly engage the strip of paper and urge the paper into a folded condition. This set up process requires that the position of each spiral be independently adjusted Accordingly, it would be highly desirable to provide an improved paper folding machine which would simultaneously locate the position of a paper strip in the machine and adjust a plurality of folding mechanisms to engage and fold the paper strip.

Therefore, it is a principal object of the invention to produce an improved apparatus for producing continuous form stationery by folding a strip of paper along transverse lines of weakening formed therealong.

Another object of the invention is to provide an improved paper folding machine which simultaneously locates a strip of paper in the machine and laterally adjusts a plurality of folding mechanisms with respect to one of the elongate edges of the strip of paper.

These and other, further and more specific objects and advantages of the invention will be apparent to those skilled in the art from the following detailed description, taken in conjunction with the drawings, in which.

Briefly, in accordance with my invention, I provide an improved apparatus for producing continuous form stationery by folding a strip of paper along transverse lines of weakening formed therein. The apparatus includes a frame; oscillating guide means mounted on the frame for alternately distributing the successive lines of weakening in the paper in substantially opposite directions; means for feeding the paper into the guide means at a predetermined speed, the paper having first and second spaced apart elongate edges; and, folding means carried on the frame and operatively associated with the oscillating guide means for urging the paper distributed by the guide means into a folded condition. The folding means includes first and second spaced apart sets of spirals shaped and dimensioned and rotatably driven to receive paper from the oscillating guide means to fold the paper along the transverse line of weakening. One of the spirals in each of the first and second sets normally engages the first elongate edge during urging of the paper into a folded condition. The improvement in the paper folding apparatus comprises means for positioning, with respect to the first elongate edge, one of the spirals in the first set and one of the spirals in the second set. The positioning means includes means for laterally locating with respect to the direction of travel of the paper through the guide means the position of the first elongate edge of the paper moving through the apparatus; and, means for simultaneously adjusting the position of one of the spirals in the first set and one of the spirals in the second set with respect to the first elongate edge to engage the first elongate edge to urge the paper distributed by the guide means into a folded condition.

Figure 1:
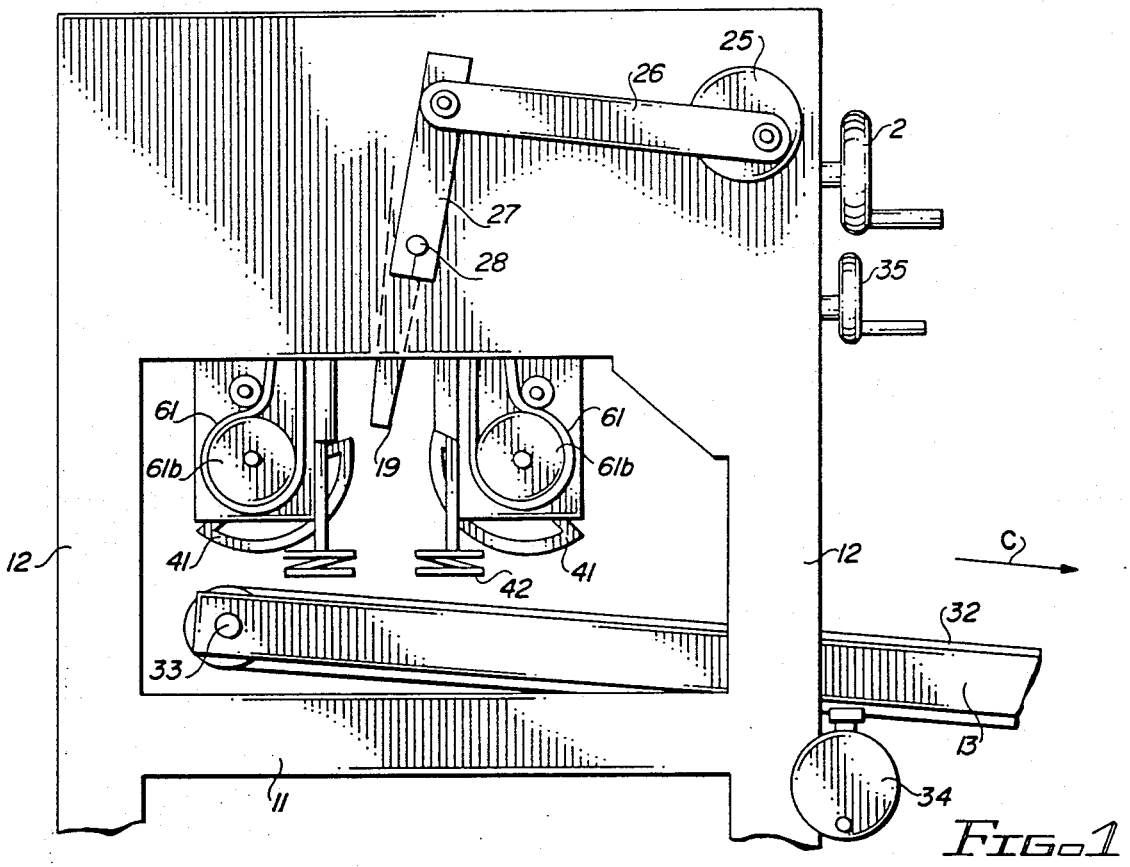
FIG. 1 is a side view of a spiral paper folding machine constructed in accordance with the principles of the invention.

Turning now to the drawings, which depict the presently preferred embodiments of the invention for the purpose of illustrating the practice thereof and not by way of limitation of the scope of the invention, and in which like reference characters identify corresponding elements throughout the several views, FIG. 1 illustrates the general arrangement of the elements in a conventional spiral paper folding machine. A frame consisting of horizontal members 11 and vertical members 12 supports conveyor table 13 and various paper folding mechanisms. A continuous strip of paper or other material is directed by a dispensing roller (not visible in FIG. 1) into chute 19 or other oscillating guide means. Transverse lines of weakening along paper entering chute 19 are distributed in substantially opposite directions as chute 19 oscillates. The paper distributed by chute 19 is compressed and folded by beaters 41 and spirals 42. Continuous moving belts carried by roller 33 carry the folded paper away from the folding mechanisms in the direction of arrow C. Arm 27, shaft 28, link 26, and gear 25 transmit motive power to chute 19. The slope of table 13 is adjusted by turning handle 34. Handle 35 is turned to adjust the position of the spirals, beaters and paper stops. The paper stops are not visible in FIG. 1, nor are all of the spirals and beaters. Handle 2 is utilized to simultaneously laterally adjust a front and rear spiral. The spiral paper folding machine illustrated in FIGS. 1 to 6 corresponds in many respects to the machine described in U.S. Pat. No. 4,522,619. The general operation of spiral paper folding machines is well understood in the art. To facilitate, however, the understanding of how the particular spiral folding machine of FIGS. 1 to 6 herein operates, like reference characters herein and in my U.S. Pat. No. 4,522,619 identify corresponding elements.

Figure 2:
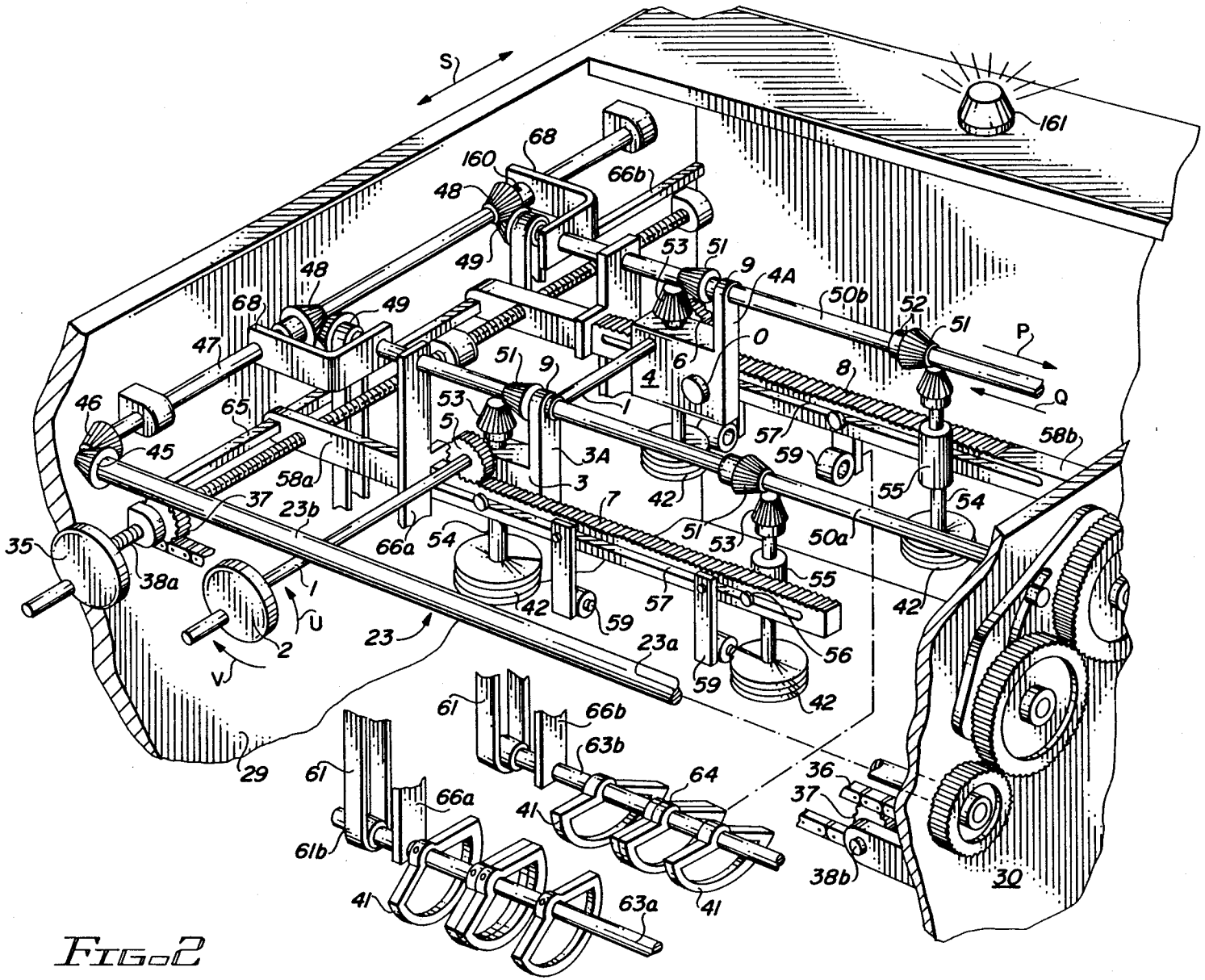
FIG. 2 is a top perspective view of the spiral paper folding machine of FIG. 1 illustrating the arrangement of certain of the folding and power transmission gear mechanisms thereof.

In FIG. 2 shafts 23*b* and 23*a* are fixedly connected and simultaneously rotate. Shaft 23*b* is connected to and rotates gear 25. Threaded shafts 38*a* and 38*b* each carry a sprocket 37 which engages continuous chain 36. By turning handle 35 shaft 38*a* is rotated causing the teeth of sprocket 37 to engage and turn continuous chain 36 so that sprockets 37 and shaft 38*b* all simultaneously rotate. Rotation of shafts 38*a* and 38*b* forwardly and rearwardly adjusts the positions of the beater, spirals and paper stops Drive shaft 23*b* is provided with a pinion gear 45 which drives gear 46 to rotate shaft 47 and bevel gears 48 mounted thereon. Gears 48 drive bevel gears 49 to rotate shafts 50*a* and 50*b* and gears 51 which are secured to shafts 50*a* and 50*b* by setscrews 52. Pinion gears 51 turn beveled gears 53 to rotate shafts 54 and spirals 42. Paper stops 59 are fixedly adjustably attached to bars 58 by set screws 60 and can, therefore, be transversely adjusting along bars 58*a* and 58*b*.

A rear set or pair of spirals 42 is operatively associated with rotatable shaft 50*b*. A front set or pair of spirals 42 is operatively associated with rotatable shaft 50*a*. The shaft 54 of one of the rear set of spirals 42 is rotatably journelled in control box 4. The shaft 54 of the other of rear set of spirals 42 is journalled for rotation in a sleeve 55. The shaft 54 of one of the front set of spirals 42 is journalled for rotation in control box 3. The shaft 54 of the other of the front set of spirals 43 is journalled for rotation in a sleeve 55. Sleeve 55 are provided with set screws 56 for transversely adjusting the position of spirals 42 along slot 57 in support bars 58.

When shafts 50*a* and 50*b* are rotated, continuous belts 61 mounted on rollers 61*a* and 61*b* affixed to rods 50 and 63 turn and simultaneously rotate shafts 63*a* and 63*b* on which beaters 41 are adjustably mounted. Set screws 64 permit beaters 41 to be positioned along shafts 63.

Figure 6:
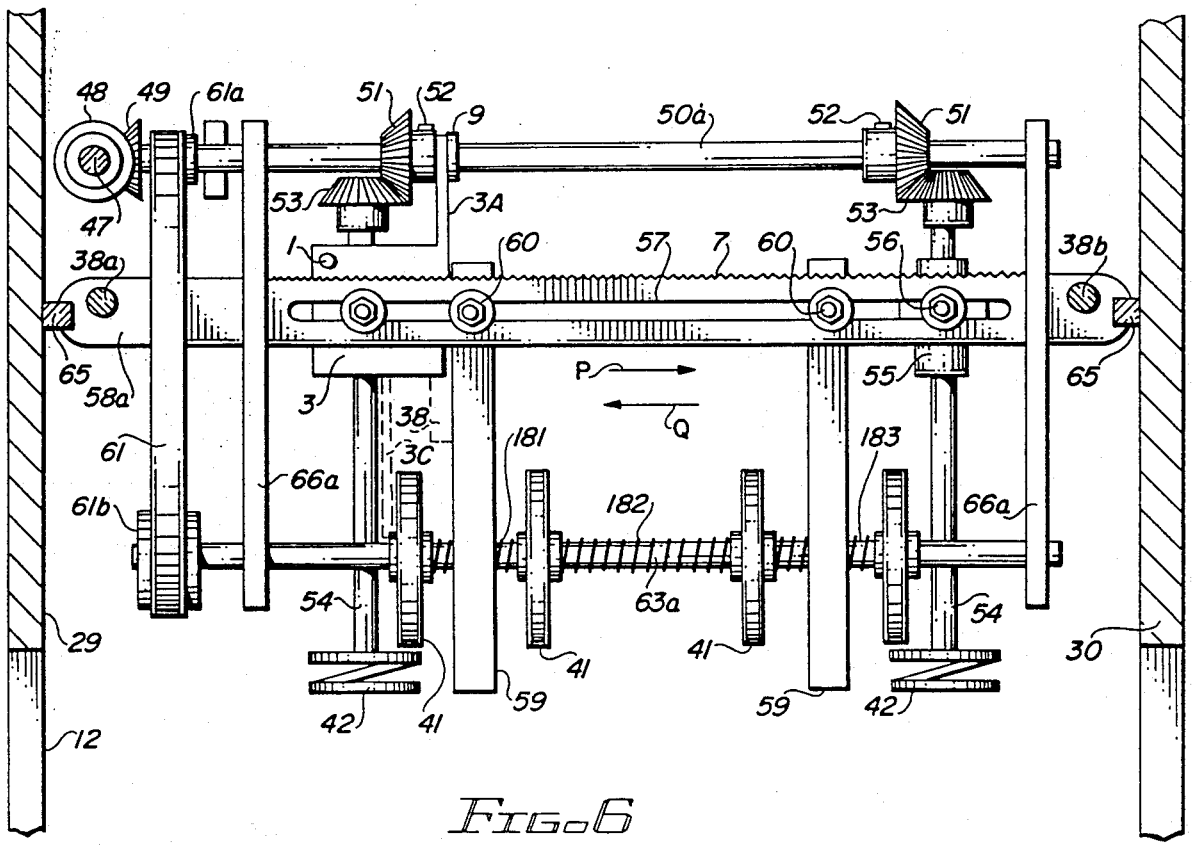
FIG. 6 is a front elevation view illustrating certain folding mechanisms of FIG. 2.

When threaded shafts 38*a* and 38*b* are rotated by turning handle 35, support bars 58*a* and 58*b* are moved in the directions indicated by arrows S along rails 65 horizontally fixedly attached to the interior of panels 39 and 30. Member 66*a* interconnects (in FIG. 2) the left hand ends of shaft 50*a*, bar 58*a* and rod 63*a*. A second member 66*a* (not visible in FIG. 2) is illustrated in FIG. 6 and interconnects the right hand ends of shaft 50*a*, bar 58*a* and rod 63*a* so that when threaded rods 38*a* and 38*b* are rotated shaft 50*a*, bar 58*a* and rod 63*a* move in unison. Member 66*b* (in FIG. 2) interconnects the left hand ends of shaft 50*b*, bar 58*b* and rod 63*b*. A second member 66*b* (not visible in FIG. 2) interconnects the right hand ends of shaft 50*b*, bar 58*b* and rod 63*b* so that when threaded rods 38*a* and 38*b* are rotated, shaft 50*b*, bar 58*b* and rod 63*b* move in unison in the directions indicated by arrows S. When the position of bars 58*a* and 58*b* are adjusted along threaded rods 38*a* and 38*b*, gears 48 slide along rod 47. L-shaped brackets 68 function to keep pinion gears 48 meshed with gears 49. Set screws 160 in gears 48 thread into an elongate longitudinal U-shaped slot (not visible) formed in shaft 47. Screws 160 permit gears 48 to freely slide longitudinally along shaft 47 while also insuring that gears 48 will rotate with shaft 47.

Figure 3A:
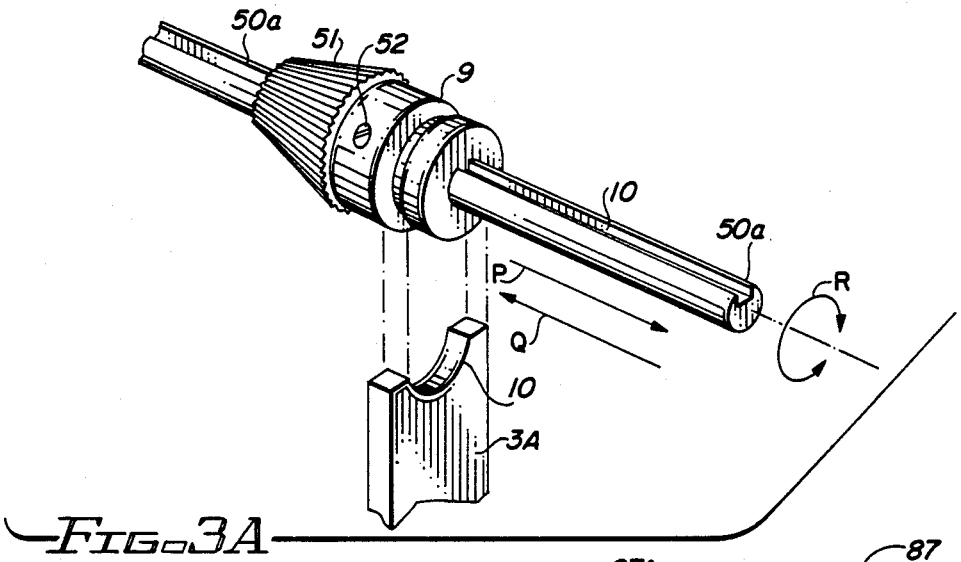
FIG. 3 is an enlarged perspective view illustrating a specific gear arrangement in FIG. 2.
FIG. 3B is a section view of the rotatable shaft of FIG. 3A.
Figure 3B:
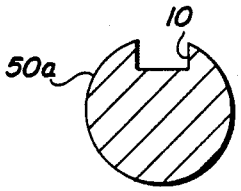

Shaft 1 is rotatably journalled in and extends through control boxes 3 and 4. Toothed gears 5 and 6 are fixedly attached to and rotate with shaft 1. Gears 5 and 6 engage toothed tracks 7 and 8 respectively. Circular U-shaped grooves 9 are formed in the neck of the pinion gears 51 adjacent control boxes 3 and 4. Grooves 9 contour to and rotatably receive U-shaped slot 10 formed in the top of each arm 3A and 4A of control boxes 3 and 4, respectively. As illustrated in FIG. 3A, when slots 10 engage a groove 9, pinions 51 are free to rotate in the directions indicated by arrows R. When, however, a control unit 3, 4 moves transversely or laterally in the directions of arrows P or Q, then rigid arms 3A and 4A force pinions 51 with grooves 9 to also move laterally. As illustrated in FIG. 3A, the pinion gears 51 adjacent control boxes 3, 4 are provided with set screws 52. These screws 52 are threaded into a longitudinal U-shaped groove 10 formed in each shaft 50*a* and 50*b*. Consequently, screws 52 enable the gears 51 adjacent boxes 3, 4 to slide along shafts 50*a* and 50*b* in the direction of arrow P or arrow Q when boxes 3, 4 (and arms 3A and 4A) move in the direction of arrow P or arrow Q. Further, screws 52 cause gears 51 adjacent boxes 3 and 4 to rotate with shafts 50*a* and 50*b* in the directions indicated by arrows R.

Handle 2 is manually grasped and rotated in the direction of arrow U or arrow V to rotate shaft 1 in a corresponding direction. A motor or any other desired means can be provided to rotate shaft 1. One motor can, if desired, be provided to rotate the portion of shaft 1 extending through gear 5 and box 3. Another separate motor can be provided to rotate the portion of shaft 1 extending through gear 6 and box 4. When two separate motors are utilized to turn gears 5 and 6, respectively, boxes 4 and 5 can still be moved simultaneously, even though they are independently controlled by separate motors.

Any desired motive power means can be provided to rotate shaft 23, and the portions 23*a* and 23*b* comprising shaft 23, and to power the folding mechanisms illustrated in FIGS. 1 and 2. Any desired paper feed mechanism can be utilized to direct a strip of paper into chute 19. My U.S. Pat. No. 4,522,619 illustrates one of any number of conventional feed mechanisms used in paper folding machines.

Handle 2 is rotated to simultaneously laterally move control boxes 3 and 4, and the spirals 42 journalled for rotation therein, in the direction of arrow P or arrow Q. The spirals in FIG. 2 which are journalled for rotation in sleeves 55 can also, in an alternate embodiment of the invention, be journalled for rotation in control boxes similar to boxes 3 and 4 and be provided with a shaft 1 and handle 2 which enables the spirals journalled for rotation in sleeves 55 in FIG. 2 to be simultaneously laterally displaced in the direction of arrow P or of arrow Q. In the embodiment of the invention illustrated in FIG. 2, however, the spirals journalled for rotation in sleeves 55 normally remain in fixed position, and engage one edge 87B of the two parallel, spaced apart edges 87A, 87B of a strip of paper 87 moving through the machine. Handle 2 is rotated so the spirals 42 carried by boxes 3, 4 are laterally simultaneously displaced in the direction of arrow P or arrow Q so the spirals 42 carried by boxes 3, 4 are positioned to engage the other edge 87A of paper strip 87.

Figure 4A:
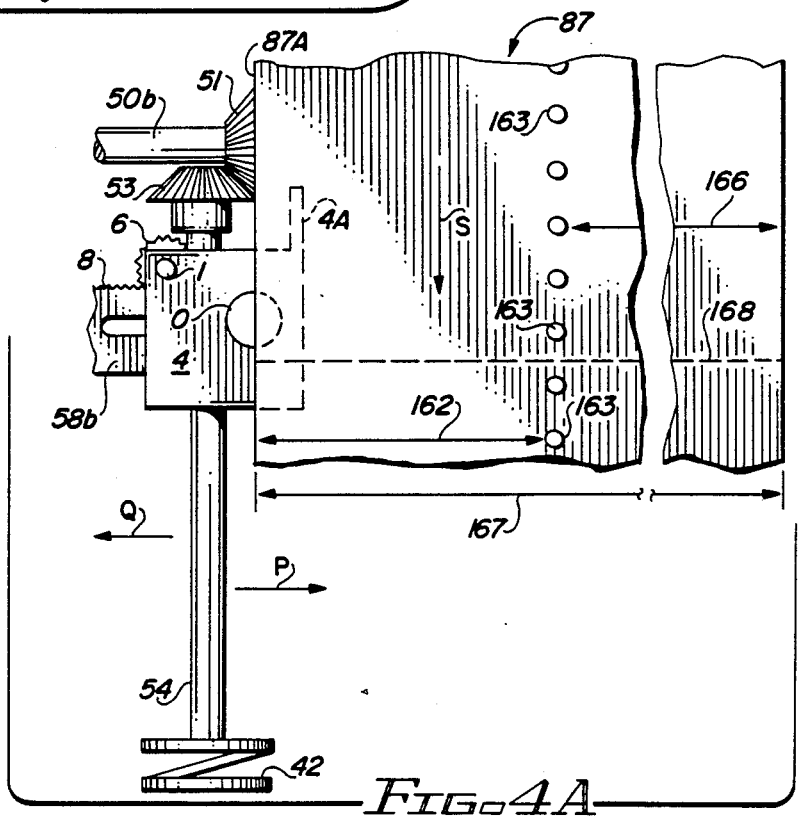
FIG. 4A is a front view of a portion of the gear arrangement of FIG. 2 illustrating a sensor used to locate a strip of paper traveling through the paper folding machine.
Figure 4B:
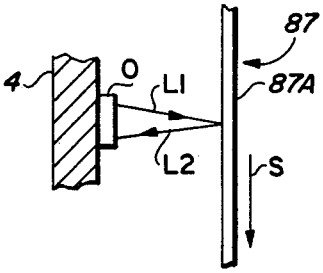
FIG. 4B is a side view illustrating the sensor of FIG. 4A.
Figure 5:
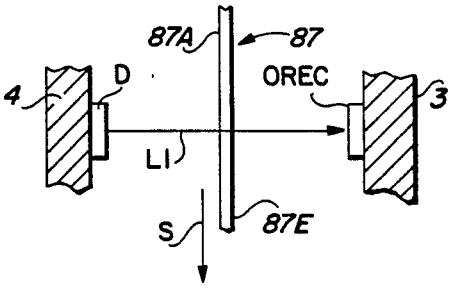
FIG. 5 is a side view illustrating an alternate sensor construction.

Before handle 2 can be manually rotated to properly laterally position the spirals 42 carried in boxes 3 and 4, the position of edge 87A of paper 87 with respect to shaft 1 and the spirals in boxes 3 and 4 must be determined. This determination can be made visually by the operator of the machine or can be made with some other sensing means. In FIG. 4A an optical sensor 0 mounted on box 4 is used to identify edge 87A of a strip of paper 87 moving through the paper folding machine. When optical sensor 0 is laterally displaced in the direction of arrow P or of arrow Q to a position where sensor 0 detects edge 87A, then the spirals 42 carried in boxes 3 and 4 are in the proper position to engage and assist in urging strip 87 in folded condition. In FIGS. 4A and 4B, sensor 0 operates by reflecting a beam of light Ll off of strip 87. When beam L1 is reflected L2 off of strip 87 and detected by sensor 0, then sensor 0 has detected the edge 87A of strip 87. An alternate sensor arrangement is illustrated in FIG. 5. Sensor 0 is used in conjunction with a receiving sensor OREC. As long as OREC detects light beam L1, strip 87 is not detected. Once a selected proportion of the light intensity in beam L1 is no longer detected by sensor OREC, then the edge 87A of strip 87 is detected. Sensor 0 is connected to light 161 illustrated in FIG. 2. When sensor 0, or sensors 0 and OREC, detect the edge 87A of strip 87, light 161 illuminates so the machine operator knows the spirals carried in boxes 3 and 4 are properly laterally positioned with respect to edge 87A.

The position of edge 87A with respect to shaft 1 and the spirals 42 carried in boxes 3 and 7 can be determined by utilizing any desired reference point on paper strip 87 or on the machine. For example, a sensor can be utilized to detect a reference mark or dot 163 imprinted on strip 87. Since the distance 162 of each mark 163 from edge 87A is known, and the shortest distance 167 from edge 87B to edge 87A is known, then the desired position the spirals in boxes 3 and 4 with respect to the spirals 42 in sleeves 55 is readily determined, and handle 2 can be rotated to move shaft 1 and boxes 3 and 4 to a position which is a proper distance from the spirals 42 journalled in sleeve 55 in FIG. 2.

Figure 7:
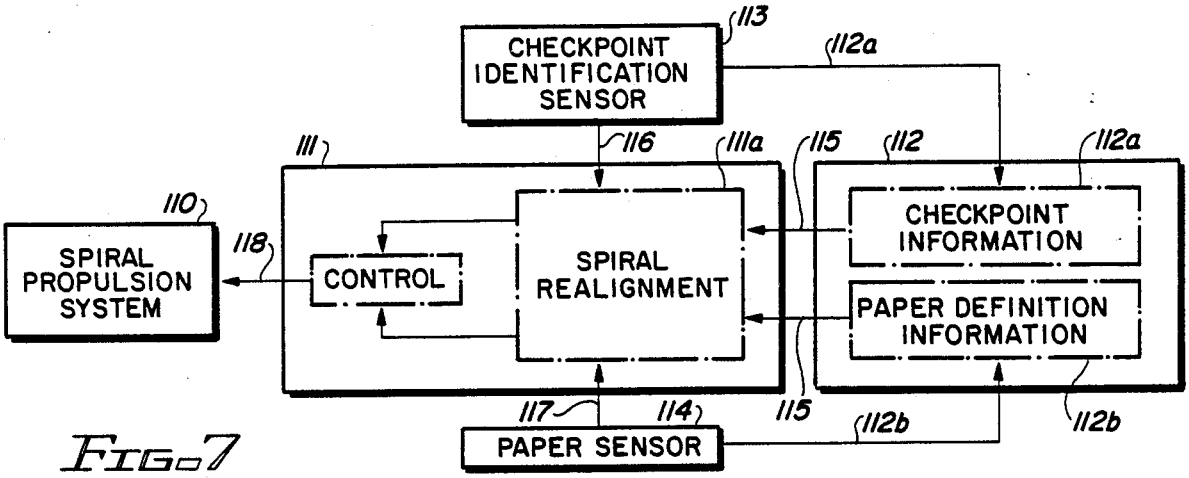
FIG. 7 is a block diagram illustrating an improved folding mechanism guidance system embodying the present invention.
Figure 8:
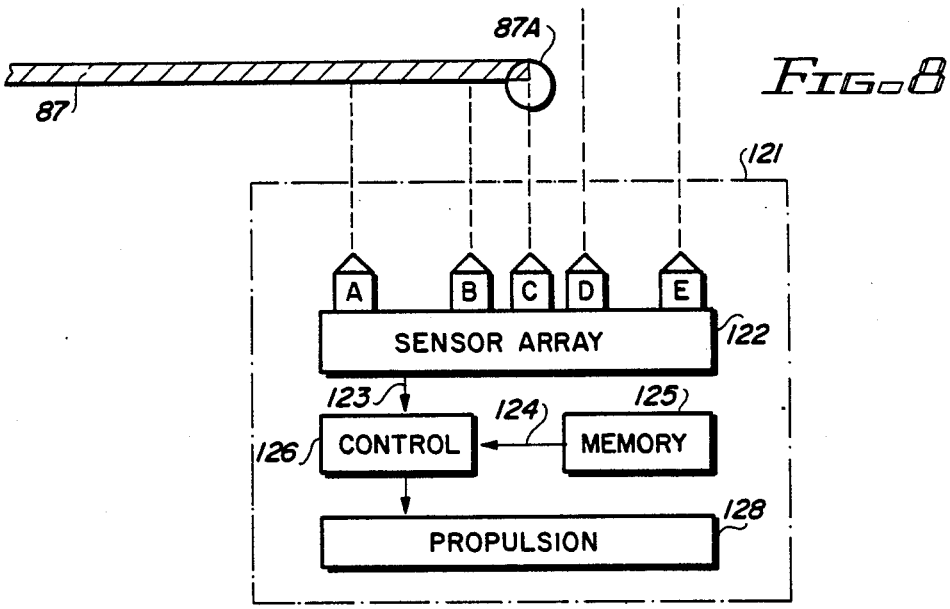
FIG. 8 illustrates a paper checkpoint sensor which is employed in the embodiment of the invention in FIG. 7; and, FIG. 9 is a block diagram which illustrates a typical program or logic function utilized in accordance with the embodiment of the invention in FIG. 7.
Figure 9:
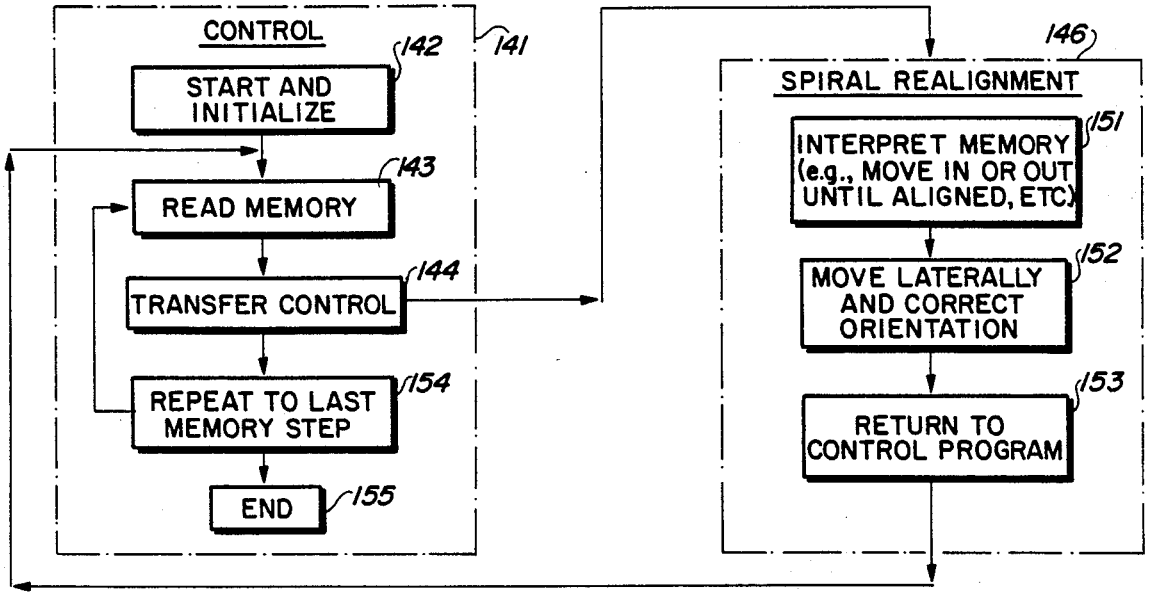

An automated embodiment of the invention is illustrated in FIGS. 7 to 9. FIG. 7 is a block diagram which illustrates a preferred embodiment of an improved spiral guidance system of the invention, the main components of which are a spiral propulsion system 110, a propulsion system controller 111, and a memory 112. A checkpoint identification sensor 113 and a paper sensor 114 are provided. The checkpoint identification sensor locates at least one edge of paper strip 87 with respect to a selected fixed reference point. For example, the sensor could laterally locate the position of reference dots 163 imprinted on paper strip 87 in FIG. 4A. The lateral distance 166 of each dot 163 from the edge 87B is known and is provided by paper sensor 114 which inputs known information concerning strip 87. Such known information includes the width 167 of strip 87 and the distances 162, 166 of reference dots 163 from edges 87A and 87B respectively. In this description of the system of FIGS. 7, 8 and 9, it is assumed that the apparatus of FIGS. 1, 2 and 6 is being utilized, that edge 87B contacts the front spiral 42 and rear spiral 42 rotatably journalled in fixed sleeves 55, and that the lateral position of edge 87B therefor comprises a fixed reference point. As used herein, the term "lateral distance" refers to the length of a line which is generally perpendicular to the direction of travel S of strip 87 through the paper folding apparatus, which is parallel to transverse lines of perforation 168 formed in strip 87 and which defines the shortest distance between two points. In FIG. 4A, the lateral distance between the fixed reference point 87B and a reference dot 163 is indicated by arrowed line 166.

The memory 112 contains both checkpoint identification information **112*a* and paper definition information 112B. The sensor 114 used to provide paper definition information can comprise a sensor array 122, can comprise a keyboard which an operator uses to input paper dimensions, distances 162, 166** etc., or can be any other suitable data input system.

After the checkpoint information **112*a* and paper definition information 112*b* are stored in the memory 112, during subsequent operational cycles this information can be recalled from the memory 112 and the recalled information 115 is fed to the controller 111, and used in the spiral realignment sub-routine to determine the proper lateral position of the spirals carried in boxes 3 and 4. Information from sensors 114, 113 is also directly fed 117, 116 to controller 111. The controller 111 generates control signals 118 which are fed to propulsion system 110 to laterally move the spirals carried in boxes 3 and 4 in the direction of arrow P or arrow Q to the desired position. The propulsion system 110 includes motor means connected to handle 2 to rotate shaft 1 and move shaft 1 and boxes 3 and 4 in the direction of arrow P or arrow Q. The spiral propulsion system 110 also includes sensor means which determines the location of boxes 3 and 4 with respect to the fixed reference point 87*b*. This enables the spiral propulsion system 110 to determine when it has moved to the position indicated 118 by controller 111. This propulsion system sensor can be an opto sensor like sensor 0** or can comprise any other desired sensor means.

The spiral propulsion system 110 can be any suitable system for laterally displacing the spirals 42 in boxes 3, 4 in the direction of arrow P and the direction of arrow Q. For example, standard stepper motors can be used to rotate shaft 1 or to turn endless tracks which turn shaft 1.

The memory 12 can be any suitable prior art memory unit such as are commonly used in industrial machines, numerical control machines, etc. For example, electromagnetic memories such as magnetic, optical, solid state, etc. or mechanical memories such as paper tape can be used.

An orientation sensor which can be employed in accordance with the presently preferred embodiment of the invention of FIGS. 7 to 9 is illustrated schematically in FIG. 8. The sensor array 122 is mounted on a box 3, 4 or is mounted at any appropriate fixed location on the apparatus of FIGS. 1 and 2. The output 123 of array 122, along with information 124 recalled from the memory 125, is processed in the controller 126 to provide command signals 127 to the spiral propulsion system 128 of the paper folding machine 121 When sensor array 122 comprises a single opto sensor 0 as illustrated in FIG. 4A, array 122 is typically mounted on a box 3, 4 or other movable member in the manner illustrated in FIG. 4A. When sensor array 122 is utilized to locate a reference point or dot 123, array 122 typically comprises a plurality of sensors A–E and is mounted at a fixed location on the apparatus of FIGS. 1 and 2.

The sensor array 122 can be a series of mechanically operated switches, ultrasound range detectors or any other suitable sensor which detects the proximity of a selected checkpoint or reference point. In FIG. 4A each reference dot 163 and the edge 87A comprise reference points or checkpoints.

FIG. 9 is a block flow diagram which illustrates a typical program or logic function which is executed by the controller 111 for location of the edge 87A of paper strip 87 and for movement of spirals 42 carried in boxes 3, 4 to a position to engage edge 87A and assist in folding strip 87. The basic control program 141 consists of commands to "start and initialize" 142, "read memory" 143 and "transfer control" 144 to the spiral realignment subroutine 146. The spiral realignment sub-routine 146 consists of commands to "interpret memory" 151 (i.e., move spiral laterally in or out until properly aligned with edge 87A) and "move laterally and correct orientation" 152 (i.e., move spiral laterally with propulsion system 110 to correct orientation of spirals 42 in boxes 3, 4 with respect to edge 87A). Command 152 is followed by "return to control program" 153. The spiral alignment sub-routine 146 is repeated as indicated by the "repeat to last memory step" 154 of the control program 141 followed by an "end" program 155 which completes the execution of the program.

In use, paper strip 87 is fed into the spiral paper folding machine of FIGS. 1, 2 and 6. While strip 87 is moving or is stationary, the lateral location or distance of at least one edge 87A of strip 87 with respect to a reference point is determined, either visually by the machine operator or with any other sensor means. Opto sensor 0 and sensor array 122 are examples of sensor means which can be utilized to determine the lateral distance of an edge 87A of strip 87 from a reference point 87B. After the lateral location of an edge 87A of strip 87 is determined, the position of the pair of spirals 42 which normally engages edge 87A is laterally simultaneously adjusted. The position of the spirals 42 in boxes 3 and 4 can be manually adjusted with handle 2 in FIG. 2. Various other motor means/gear means can be provided to simultaneously laterally adjust spirals 42 in the direction of arrow P or arrow Q into proper engagement with edge 87A. An automatic computerized system like that of FIGS. 7 to 9 can be utilized to automatically laterally adjust spirals 42 when a strip of paper is directed into a spiral folding machine.

As would be appreciated by those of skill in the art, other folding mechanisms can be simultaneously laterally displaced along with spirals 42. For example, if in FIG. 6, rigid structural member 3B interconnects box 3 and paper stop 59, and if in FIG. 6 set screw 60 is loosened sufficiently to permit the top of stop 59 to freely slide along slot 57 in the direction of arrows P and Q, then when box 3 is displaced in the direction of arrow P paper stop 59 moves in the direction of arrow P, and when box 3 is laterally displaced in the direction of arrow Q, paper stop 59 is displaced in the direction of arrow Q. Similarly, if in FIG. 6 rigid structural member 3C is connected to box 3 and bears against, but is not connected to, the hub of a spiral 41 in the manner illustrated, then when box 3 is laterally displaced in the direction of arrow P, structural member 3C can slidably push the beater 41 along shaft **63*a* in the direction of arrow P. In this case a U-shaped longitudinal slot is formed in shaft 63*a* and a set screw in the hub of the beater 41 extends into the longitudinal slot in the same manner in which set screw 52 extends into longitudinal slot 10 in FIG. 3A. This set screw——longitudinal slot arrangement enables beater 41 both to be slidably laterally moved along shaft 63*a* and to simultaneously rotate with shaft 63*a***.

In FIG. 6, springs 181, 182 183 prevent each spiral 41 from sliding up against a neighboring spiral 41 and maintain a spacing between the spirals.

Having described my invention in such terms as to enable those skilled in the art to understand and practice it, and having identified the presently preferred embodiments thereof, I claim:

1. In combination with apparatus for producing continuous form stationery by folding a strip of paper along transverse line of weakening formed therein, said apparatus including a frame oscillating guide means mounted on said frame for alternately distributing said successive lines of weakening in said paper in substantially opposite direction, means for feeding said paper into said guide means at a predetermined speed, said paper having first and second spaced apart elongate edges and having front and back faces, folding means carried on said frame and operatively associated with said oscillating guide means for urging said paper distributed by said guide means into a folded condition, said folding means including first and second spaced apart sets of spirals shaped and dimensioned and rotatably driven to receive paper from said oscillating guide means to fold the paper along the transverse lines of weakening, one of said spirals in each of said first and second sets normally engaging said first elongate edge during urging of said paper into a folded condition, the improvements comprising means for positioning, with respect to said first elongate edge, said one of said spirals in said first set and said one of said spirals in said second set, said positioning means including (a) means for laterally simultaneously adjusting the position of said one of said spirals in said first set and said one of said spirals in said second set with respect to said first elongate edge to engage said first elongate edge to urge said paper distributed by said guide means into a folded condition, said lateral adjustment means including (i) a first rotatable elongate shaft which is above, is at an angle with respect to said faces of, and is laterally spaced away from said first edge and from said faces of said paper moving through said guide means for distribution thereby, (ii) at least one track generally parallel to paper moving through said guide means, (iii) first gear box means carrying said one of said spirals in said first set and said elongate shaft, said one of said spirals in said first set downwardly extending from said first gear box means, (iv) second gear box means carrying said set and said elongate shaft, said one of said spirals in said second set downwardly extending from said second gear box means, (v) means for rotating said elongate shaft, (vi) means carried on said elongate shaft for engaging said track such that when said shaft is rotated by said rotating means, said engaging means moves along said track such that said elongate shaft, said one of said spirals in said first set, and said one of said spirals in said second set simultaneously each move n a lateral direction of travel which is parallel to said paper moving through said guide means and is toward the other of said spirals in said first and second sets;

(b) sensor means mounted on said apparatus for determining when said one of said first set of spirals and said one of said second set of spirals are each aligned with said first elongate edge of said paper; and, (c) at least one beater for periodically tamping said paper distributed by said chute, said beater (i) assisting in the folding and positioning of said paper, (ii) being movably mounted on a second rotatable shaft for rotation therewith and for sliding movement which is along the shaft intermediate said spirals in said first set and is in a direction parallel to paper moving through said guide means, said first gear box means being shaped and dimensioned to contact and slidably move said beater along said second rotatable shaft when said first rotatable elongate shaft is rotated with said rotating means to move said first gear box means toward said other of said spirals in said first set.

2. The apparatus of claim 1 wherein said rotating means comprises a manually operated handle attached to said first rotatable shaft.

3. In combination with apparatus for producing continuous form stationery by folding a strip of paper along transverse lines of weakening formed therein, said apparatus including a frame oscillating guide means mounted on said frame for alternately distributing said successive lines of weakening in said paper in substantially opposite direction, means for feeding said paper into said guide means at a predetermined speed, said paper having first and second spaced apart elongate edges and having front and back faces, folding means carried on said frame and operatively associated with said oscillating guide means for urging in said paper distributed by said guide means into a folded condition, said folding means including first and second spaced apart sets of spirals shaped and dimensioned and rotatably driven to receive paper from said oscillating guide means to fold the paper along the transverse lines of weakening, one of said spirals in each of said first and second sets normally engaging said first elongate edge during urging of said paper into a folded condition, the improvements comprising means for positioning, with respect to said first elongate edge, said one of said spirals in said first set and said one of said spirals in said second set, said positioning means including (a) means for laterally simultaneously adjusting the position of said one of said spirals in said first set and said one of said spirals in said second set with respect to said first elongate edge to engage said first elongate edge to urge said paper distributed by said guide means into a folded condition, said lateral adjustment means including (i) a first rotatable elongate shaft which is above, is at an angle with respect to said faces of, and is laterally spaced away from said first edge and from said faces of said paper moving through said guide means for distribution thereby, (ii) at least one track generally parallel to paper moving through said guide means, (iii) first gear box means carrying said one of said spirals in said first set and said elongate shaft, said one of said spirals in said first set downwardly extending from said first gear box means, (iv) second gear box means carrying said one of said spirals in said second set and said elongate shaft, said one of said spirals in said second set downwardly extending from said second gear box means, (v) means for rotating said elongate shaft, (vi) means carried on said elongate shift for engaging said track such that when said shaft is rotated by said rotating means, said engaging means moves along said track such that said elongate shaft, said one of said spirals in said first set, and said one of said spirals in said second set simultaneously each move in a lateral direction of travel which is parallel to said paper moving though said guide means and is toward the other of said spirals in said first and second sets;

(b) at least a first beater for periodically tamping said paper distributed by said guide means, said beater (i) assisting in the folding and positioning of said paper, (ii) being moveably mounted on a second rotatable shaft for rotation therewith and for sliding movement along said second shaft intermediate said spirals in said first set and in a direction parallel to paper moving through said guide means; and, (c) resilient means extending intermediate said beater and said first gear box means; the rotation of said first elongate shaft to move said first gear box means toward said other of said spirals in said first set compressing said resilient means intermediate said first beater and said gear box means, said resilient means when compressed a selected amount generating sufficient force to press said first beater away from said first gear box means slidably along said second shaft toward said other of said spirals in said first set.

4. The apparatus of claim 3 including sensor means mounted on said apparatus for determining when said one of said first set of spirals and said one of said second set of spirals are each aligned with said first elongate edge of said paper.

5. The apparatus of claim 4 wherein said sensor means is mounted on at least one of a pair comprising said first gear box means and said second gear box means.

6. The apparatus of claim 5 wherein said sensor means detects said first elongate edge to determine when said one of said first set of spirals and said one of said second set of spirals are each aligned with said first elongate edge of said paper.

7. In combination with apparatus for producing continuous form stationery by folding a strip of paper along transverse lines of weakening formed therein, said apparatus including a frame oscillating guide means mounted on said frame for alternately distributing said successive lines of weakening in said paper in substantially opposite direction, means for feeding said paper into said guide means at a predetermined speed, said paper having first and second spaced apart elongate edges and having front and back faces, folding means carried on said frame and operatively associated with said oscillating guide means for urging said paper distributed by said guide means into a folded condition, said folding means including first and second spaced apart sets of spirals shaped and dimensioned and rotatably driven to receive paper from said oscillating guide means to fold the paper along the transverse lines of weakening, one of said spirals in each of said first and second sets normally engaging said first elongate edge during urging of said paper into a folded condition, the improvements comprising means for positioning, with respect to said first elongate edge, said one of said spirals in said first set and said one of said spirals in said second set, said positioning means including (a) means for laterally adjusting with respect to said first elongate edge the position of said one of said spirals in said first set and said one of said spirals in said second set to engage said first elongate edge to urge said paper distributed by said guide means into a folded condition, said lateral adjustment means including (i) a structure mounted on said apparatus and rotatably carrying said one of said spirals in said first set, (ii) means for laterally displacing said structure in a direction of travel toward the other end of said spirals in said first set;

(b) a first beater for periodically tamping said paper distributed by said guide means, said beater (i) assisting in the folding and positioning of said paper, (ii) being movably mounted on a second rotatable shaft for rotation therewith and for sliding movement along said second shaft intermediate said spirals in said first set and in a direction parallel to paper moving through said chute, (c) first resilient means extending intermediate said beater and said structure, the movement by said lateral displacement of said structure toward the other of said spirals in said first set compressing said resilient means intermediate said first beater and said structure, said resilient means when compressed a selected amount generating a sufficient force to press said first beater away from said structure slidably along said second shaft toward said other of said spirals in said first set;

(d) a second beater for periodically tamping said paper distributed by said guide means, said second beater being movably mounted on said second rotatable shaft between said first beater and said other of said spirals in said first set for rotation with said second shaft and for sliding movement along said second shaft intermediate said spirals in said first set and in a direction parallel to paper moving through said guide means; and, (e) second resilient means extending intermediate said first and second beaters to maintain a selected spacing between said first and second beaters when said first beater slides a selected distance along said second shaft toward said thereof said spirals in said first set;

said second resilient means generating a force against said first beater opposing the force generated by said first resilient means.

* * * * *